US012065813B2

(12) United States Patent
Downey et al.

(10) Patent No.: US 12,065,813 B2
(45) Date of Patent: Aug. 20, 2024

(54) FAUCET WITH CANTILEVERED SUPPORT ARM

(71) Applicant: ASSA ABLOY Americas Residential Inc., New Haven, CT (US)

(72) Inventors: David Downey, Lake Forest, CA (US); Selia Ke, Xiamen (CN)

(73) Assignee: ASSA ABLOY Americas Residential Inc., New Haven, CT (US)

( * ) Notice: Subject to any disclaimer, the term of this patent is extended or adjusted under 35 U.S.C. 154(b) by 0 days.

(21) Appl. No.: 18/165,483

(22) Filed: Feb. 7, 2023

(65) Prior Publication Data

US 2023/0250618 A1 Aug. 10, 2023

(30) Foreign Application Priority Data

Feb. 7, 2022 (CN) ..... 202210115874.6

(51) Int. Cl.
*E03C 1/04* (2006.01)

(52) U.S. Cl.
CPC .... *E03C 1/0412* (2013.01); *E03C 2001/0415* (2013.01); *Y10T 137/9464* (2015.04)

(58) Field of Classification Search
CPC ..... E03C 2001/0414; E03C 1/0412; Y10T 137/9464
USPC ..... 137/801
See application file for complete search history.

(56) References Cited

U.S. PATENT DOCUMENTS

| | | | |
|---|---|---|---|
| D448,067 | S | 9/2001 | Pitsch |
| 6,820,291 | B1 | 11/2004 | Weaver |
| D519,190 | S | 4/2006 | Lord |
| D525,344 | S | 7/2006 | Schaffeld |
| 7,090,154 | B2 | 8/2006 | Herring |
| D533,256 | S | 12/2006 | Schaffeld |
| D533,922 | S | 12/2006 | Miao |
| D573,696 | S | 7/2008 | Eilmus |
| D585,110 | S | 1/2009 | Paini |
| D587,343 | S | 2/2009 | Nobili |
| D598,979 | S | 8/2009 | Nobili |
| D634,815 | S | 3/2011 | Barry |
| D651,284 | S | 12/2011 | Flowers et al. |

(Continued)

FOREIGN PATENT DOCUMENTS

| | | |
|---|---|---|
| CA | 115319 | 12/2006 |
| CA | 183175 | 11/2020 |

(Continued)

OTHER PUBLICATIONS

Amazon.com, "Kohler 29106-2BZ Bellera Kitchen Sink Faucet, Oil-Rubber Bronze", obtained online, 2022, 11 pages.

(Continued)

*Primary Examiner* — Daphne M Barry

(74) *Attorney, Agent, or Firm* — Merchant & Gould P.C.

(57) ABSTRACT

A faucet includes a faucet body having a base, a support arm cantilevered from the base, and a bracket formed on a free end of the support arm. A flexible hose has one end coupled to the faucet body. A spray head is coupled to the other end of the flexible hose such that the flexible hose has a fixed length between the faucet body and the spray head. The spray head has an outer surface with a recess formed therein and is configured to receive the bracket such that the spray head is releasably coupled to the faucet body.

19 Claims, 9 Drawing Sheets

(56) References Cited

U.S. PATENT DOCUMENTS

| | | | |
|---|---|---|---|
| D681,783 | S | 5/2013 | Chong |
| D685,881 | S | 7/2013 | Fritz |
| D687,127 | S | 7/2013 | Fritz |
| 8,713,725 | B2 | 5/2014 | Alder et al. |
| D708,713 | S | 7/2014 | Yu |
| D709,166 | S | 7/2014 | Yu |
| 8,869,821 | B2 | 10/2014 | Laera |
| D735,298 | S | 7/2015 | Eads |
| D737,937 | S | 9/2015 | Flowers et al. |
| D761,392 | S | 7/2016 | Hanna |
| 9,435,107 | B2 | 9/2016 | Rexach |
| D783,780 | S | 4/2017 | Clarke |
| D793,536 | S | 8/2017 | Fritz |
| D795,397 | S | 8/2017 | Clarke |
| 9,850,642 | B2 | 12/2017 | Enlow et al. |
| D810,875 | S | 2/2018 | Bahler |
| D810,883 | S | 2/2018 | Bahler |
| D812,195 | S | 3/2018 | Clarke |
| D812,196 | S | 3/2018 | Clarke |
| D819,178 | S | 5/2018 | Clarke |
| D823,991 | S | 7/2018 | Schaubach |
| D833,577 | S | 11/2018 | Clarke |
| D835,238 | S | 12/2018 | Ziemann et al. |
| D837,938 | S | 1/2019 | Clarke |
| D837,939 | S | 1/2019 | Clarke |
| D840,511 | S | 2/2019 | Garland et al. |
| 10,233,618 | B2 | 3/2019 | Clarke et al. |
| 10,233,619 | B1 | 3/2019 | Lin et al. |
| 10,260,217 | B2 | 4/2019 | Enlow et al. |
| D853,533 | S | 7/2019 | Rexach |
| D855,155 | S | 7/2019 | Stuart |
| D855,767 | S | 8/2019 | Gessi |
| D856,485 | S | 8/2019 | Gessi |
| D858,709 | S | 9/2019 | Xuan |
| 10,519,635 | B2 | 12/2019 | Fourman et al. |
| D879,255 | S | 3/2020 | Kwok |
| D884,123 | S | 5/2020 | Eads |
| 10,648,579 | B2 | 5/2020 | Guo |
| D886,239 | S | 6/2020 | Gessi |
| 10,669,701 | B2 | 6/2020 | Hadfield et al. |
| D895,066 | S | 9/2020 | Johnson |
| D907,745 | S | 1/2021 | Stoler |
| D908,842 | S | 1/2021 | Johnson |
| 10,927,531 | B2 | 2/2021 | Fourman et al. |
| D913,442 | S | 3/2021 | Sieger |
| D914,141 | S | 3/2021 | Takano |
| D916,241 | S | 4/2021 | Joseph |
| D919,770 | S | 5/2021 | Maris |
| 11,085,175 | B2 | 8/2021 | Fourman et al. |
| D930,791 | S | 9/2021 | Williams et al. |
| D941,437 | S | 1/2022 | Johnson |
| 11,214,946 | B2 | 1/2022 | Chung |
| 11,220,808 | B2 | 1/2022 | Tentler |
| D954,909 | S | 6/2022 | Valco |
| D996,574 | S | 8/2023 | Downey |
| D996,575 | S | 8/2023 | Downey |
| 2008/0196160 | A1 | 8/2008 | Alder et al. |
| 2009/0120516 | A1 | 5/2009 | Paini |
| 2013/0019974 | A1 | 1/2013 | Laera |
| 2014/0069511 | A1* | 3/2014 | Rexach ..... E03C 1/0404 137/15.01 |
| 2017/0350104 | A1* | 12/2017 | Clarke ..... E03C 1/0404 |
| 2018/0030700 | A1* | 2/2018 | Zindler ..... E03C 1/0405 |
| 2019/0003162 | A1* | 1/2019 | Fourman ..... F16K 19/006 |
| 2019/0106866 | A1 | 4/2019 | Clarke et al. |
| 2020/0048879 | A1* | 2/2020 | Hadfield ..... E03C 1/0404 |
| 2021/0332570 | A1 | 10/2021 | Fourman et al. |

FOREIGN PATENT DOCUMENTS

| | | |
|---|---|---|
| CA | 183179 | 11/2020 |
| CA | 190290 | 2/2021 |
| CA | 190265 | 3/2021 |
| CN | 301539438 | 5/2011 |
| CN | 301761134 | 12/2011 |
| CN | 301858541 | 3/2012 |
| CN | 302105713 | 10/2012 |
| CN | 304211829 | 7/2017 |
| CN | 305393012 | 10/2019 |
| CN | 305587564 | 2/2020 |
| CN | 305656059 | 3/2020 |
| CN | 306094063 | 10/2020 |
| CN | 306119712 | 10/2020 |
| CN | 306274405 | 1/2021 |
| CN | 306337746 | 2/2021 |
| CN | 306581470 | 6/2021 |
| CN | 306688189 | 7/2021 |
| CN | 306916738 | 11/2021 |
| CN | 306929963 | 11/2021 |
| EM | 008469373-0001 | 3/2021 |
| EM | 008469373-0002 | 3/2021 |
| EP | 3043000 | 7/2016 |
| EP | 2706156 | 5/2017 |
| EP | 3276090 | 6/2020 |
| JP | 2620073 | 8/1987 |

OTHER PUBLICATIONS

Amazon.com, "Kohler Semi-Professional Kitchen Faucet with Soap Dispenser", obtained online, 2022, 8 pages.

Lowes.com, "Lilyfield Pro single-handle semi-professional kitchen sink faucet", obtained online, 2022, 4 pages.

The Home Depot, "Addison single lever handle in Champagne Bronze", obtained online, 2022, 11 pages.

The Home Depot, "Small Innovations Handle Bases in white", obtained online, 2022, 5 pages.

Wayfair.com, "Moen Sleek Spring pull down single handle kitchen faucet", obtained online, 2022, 11 pages.

* cited by examiner

FAUCET WITH CANTILEVERED SUPPORT ARM

CROSS-REFERENCE TO RELATED APPLICATIONS

This application claims priority to and the benefit of Chinese Patent Application No. 202210115874.6, filed Feb. 7, 2022, and which is hereby incorporated by reference herein in its entirety.

BACKGROUND

Faucets may be found in many different rooms of a building, including bathrooms and kitchens. These faucets can include a spray head which is configured to discharge water when being operated by one or more handles.

Some known spray heads are attached to a pull out hose so that the spray head can be detached from a faucet body and moved relative to a basin to reach all portions of the basin, and returned to a mounting position, with the pull out hose retracting back through the faucet body and stored below the countertop or other mounting surface. Such a pull out faucet is often used in the context of kitchen faucets, which typically have a significant amount of room available below the mounting surface for storage of the excess hose when the spray head is in the mounting position. In some instances, pull out faucets are also used in bathroom applications; however, there is less need for such a pull out faucet because typically a bathroom basin is smaller. Furthermore, there is often less room available (if any) below a mounting surface of the faucet. In some instances, such as for use with pedestal sinks, there may not be any unexposed undersink area where retracted hose may be stored.

In some other example faucets, a detachable spray head may be supported directly on the faucet body, with the hose supported on an extension support arm. In such an arrangement, sometimes referred to as a "culinary" faucet, a spray head will be attached to an exposed, flexible hose having at least a portion of the hose disposed within a spring or other support extending above the faucet body. These extension support arms are often pivotable so that the position of the spray head while attached to the extension support arm is adjustable. However, attaching and detaching the spray head to the extension support arm is often difficult because of all of the moving parts. Additionally, because of the spray head adjustability, components have increased wear and often do not have a sleek, modern configuration. Accordingly, improvements are desired.

SUMMARY

The present disclosure relates generally to faucets with a releasable spray head. In one possible configuration, and by non-limiting example, faucets with a fixed support arm and an exposed external flexible hose for the spray head are disclosed.

In an aspect, the technology relates to a faucet including: a faucet body including: a base having a bottom inlet opening and a top outlet opening; a support arm cantilevered from the base and having a free end; and a bracket formed on the free end of the support arm, wherein the base, the support arm, and the bracket are of unitary construction; a flexible hose having a first end and an opposite second end, the second end coupled to the top outlet opening of the base; and a spray head having a top end and an opposite bottom end, the top end coupled to the first end of the flexible hose such that the flexible hose has a fixed length between the faucet body and the spray head, the spray head having an outer surface with a recess formed therein and configured to receive the bracket such that the spray head is releasably coupled to the faucet body, wherein the recess extends from the bottom end towards the top end such that a height of the recess extends over half of a height of the spray head.

In an example, the spray head is substantially frustoconical in shape and the recess has a circumferential length, and a surface area of recess within the outer surface is more than 25% of a total surface area of the outer surface of the spray head. In another example, when the spray head is coupled to the faucet body, the flexible hose has a curved shape that aligns above the support arm. In yet another example, when the spray head is disengaged with the bracket, the flexible hose allows the spray head to be moved by a user to a position remote from the faucet body while resiliently returning to the curved shape when the spray head is coupled to the faucet body. In still another example, the curved shape is based on a thickness and a durometer of the flexible hose. In an example, the bottom inlet opening defines a vertical axis, the top outlet opening having an outlet axis that is angled relative to the vertical axis. In another example, when the spray head is coupled to the faucet body, the first end of the flexible hose defines a first axis and the second end of the flexible hose defines a second axis, the first axis is not parallel with the second axis, and the first axis and the second axis are each not parallel with a vertical axis.

In another aspect, the technology relates to a faucet including: a faucet body including: a base having a bottom inlet opening defining an inlet axis and a top outlet opening defining an outlet axis, the inlet axis being non-parallel to the outlet axis; a support arm cantilevered from the base and having a free end; and a bracket disposed at the free end of the support arm; a flexible hose having a first end and an opposite second end, the second end coupled to the top outlet opening of the base and at least a portion of the second end of the flexible hose is coaxial with the outlet axis; and a spray head coupled to the first end of the flexible hose such that the flexible hose has a fixed length between the faucet body and the spray head, the spray head being releasably coupled to the faucet body at the bracket.

In an example, the base and the support arm are not rotatable around the inlet axis, and the base and the support arm define a plane parallel with the inlet axis. In another example, when the spray head is coupled to the faucet body, the flexible hose has a substantially curved shape and aligned with the plane defined by the base and the support arm. In yet another example, the flexible hose does not include a spring or an outer support sheath. In still another example, the outlet axis of the top outlet opening is angled away from a direction that the support arm extends from the base. In an example, the bracket is coupled to the free end of the support arm via a pivot joint such that the bracket is pivotable relative to the support arm. In another example, the spray head has a top end coupled to the first end of the flexible hose and an opposite bottom end, the bottom end of the spray head configured to attach to the bracket.

In another aspect, the technology relates to a faucet including: a faucet body including: a base having a bottom inlet opening defining an inlet axis and a top outlet opening defining an outlet axis, the outlet axis angled relative to the inlet axis; a support arm cantilevered from the base and having a free end; and a bracket formed on the free end of the support arm, wherein the base, the support arm, and the bracket are of unitary construction such that the bracket has a fixed position on the faucet body; a flexible hose having a first end and an opposite second end, the second end coupled to the top outlet opening of the base; a spray head having a top end and an opposite bottom end, the top end coupled to the first end of the flexible hose such that the flexible hose has a fixed length between the faucet body and the spray head that is exposed, the spray head having an outer surface with a recess formed therein and configured to completely receive the bracket such that the outer surface is substantially flush with the bracket, wherein the bracket releasably couples the spray head to the faucet body, and wherein the recess is disposed proximate the bottom end of the spray head.

In an example, rotation of the second end of the flexible hose around the outlet axis is prevented. In another example, rotation of the first end of the flexible hose relative to the spray head is prevented. In yet another example, the flexible hose is defined by a thickness and a durometer such that the spray head is moveable relative to the faucet body when detached from the bracket, and maintains a substantially curved shape when the spray head is coupled to the bracket above the spray head and the faucet body. In still another example, at least one faucet handle is disposed remote from the faucet body. In an example, the bracket is C-shaped, and when the spray head is coupled to the bracket, the bracket extends at least 120° around the spray head.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular examples of the present disclosure and therefore do not limit the scope of the present disclosure. The drawings are not to scale and are intended for use in conjunction with the explanations in the following detailed description. Examples of the present disclosure will hereinafter be described in conjunction with the appended drawings, wherein like numerals denote like elements.

DETAILED DESCRIPTION

Figure 1:
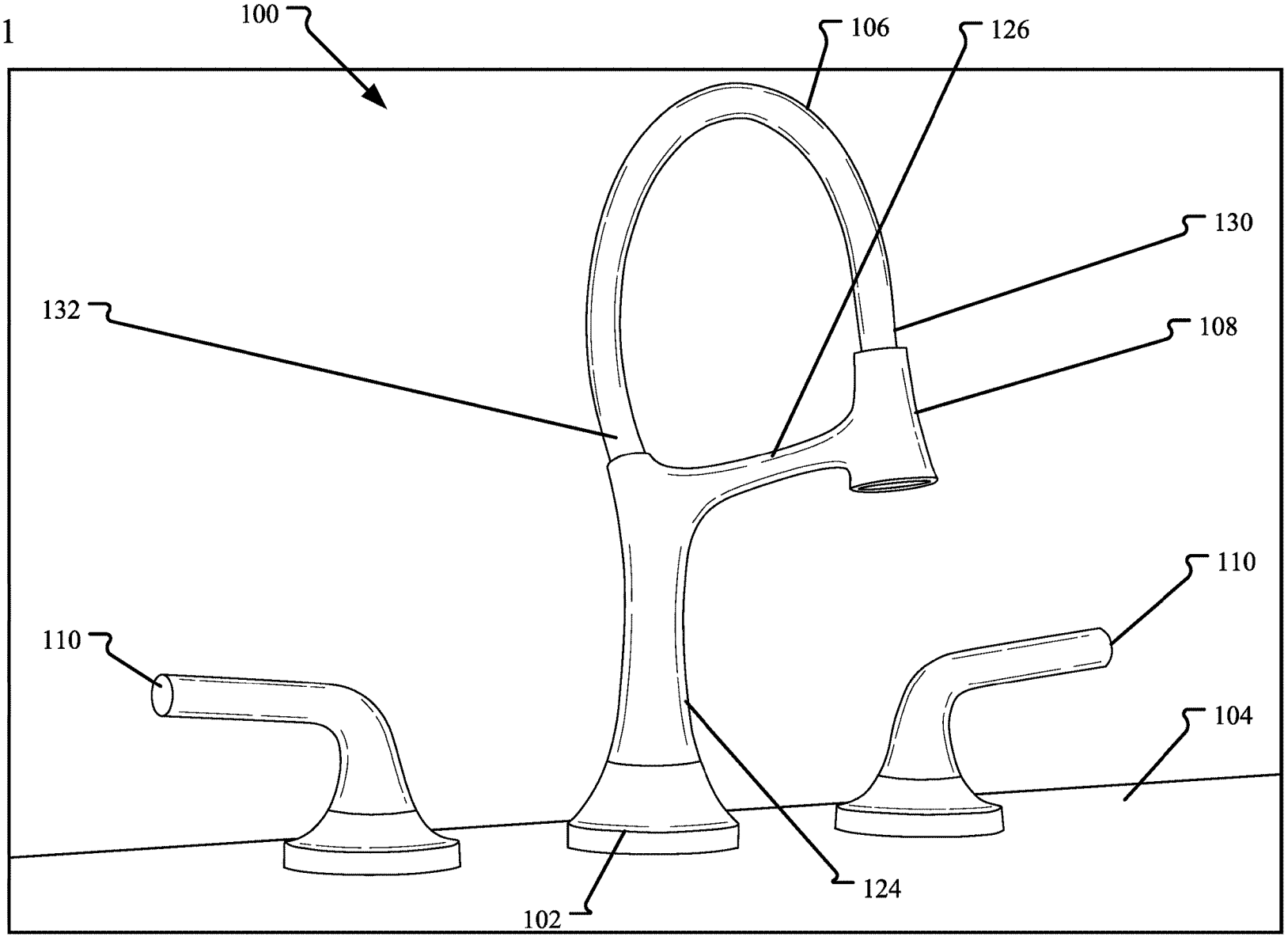
FIG. 1 is a perspective view of an exemplary faucet in an attached spray head configuration and in accordance with the principles of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

A faucet is disclosed herein with increased performance and manufacturing features. The faucet includes a faucet body, a flexible hose, and a spray head, whereby the spray head can be attached and detached from the faucet body and movable via the flexible hose that is exterior of the faucet body and the spray head. For example, the faucet body can include a support arm for the spray head and a base configured to be secured to a sink basin in a bath and/or a countertop in a kitchen. The support arm and the base are unitarily formed such that the support arm and the base are not movable relative to one another so as to simplify manufacturing and increase performance for the user. The faucet body is also shaped and sized so as to at least partially define a curved shape of the flexible hose that attaches between the spray head and the faucet body.

The flexible hose is exposed within the faucet so as to easily convey the detachable functionality of the spray head to the user. For example, the flexible hose has a fixed length defined between the spray head and the faucet body. The flexible hose has material properties that are flexible enough to enable the spray head to be movable relative to the faucet body when detached from the support arm, but stiff enough such that when the spray head is attached to the support arm, the flexible hose resiliently maintains an upright curved shape above the support arm. For example, the flexible hose has a thickness and/or a durometer that facilitates such function.

Additionally, the free end of the support arm includes a bracket to releasable support the spray head. The bracket may be integrally formed with the support arm or may be pivotably coupled thereto. An attachment interface between the bracket and the spray head is disposed at a bottom end of the spray head so as to increase ease of use for the user. Additionally, the size and shape of the attachment interface increases attachment/detachment performance for the user while the faucet is in operation.

Figure 2:
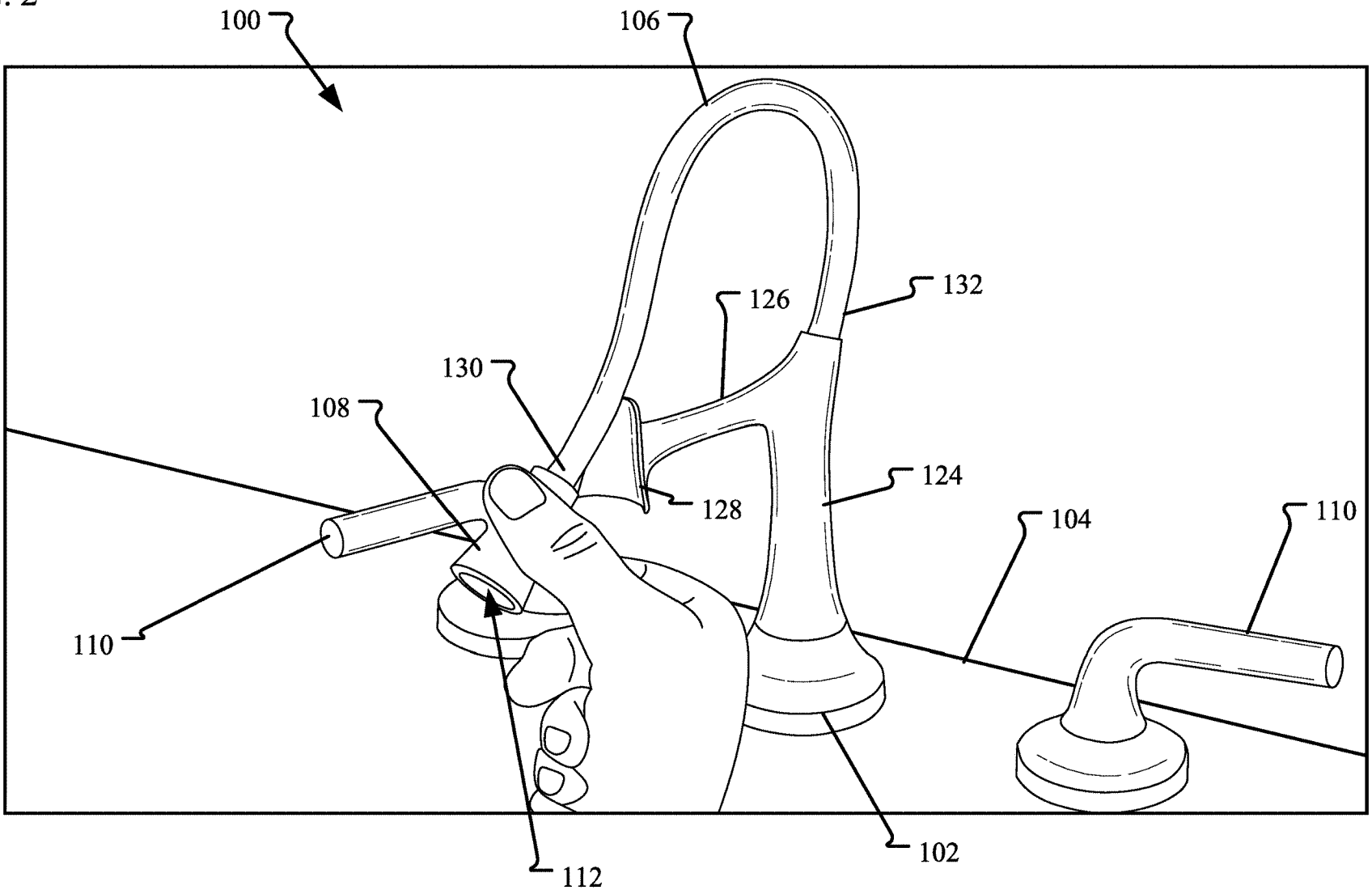
FIG. 2 is a perspective view of the faucet shown in FIG. 1 in a detached spray head configuration.

FIG. 1 is a perspective view of an exemplary faucet 100 in an attached spray head configuration. FIG. 2 is a perspective view of the faucet 100 in a detached spray head configuration. Referring concurrently to FIGS. 1 and 2, the faucet 100 includes a faucet body 102 configured to mount on a sink basin 104 of a bath and the faucet 100 can be considered a bath faucet. It should be appreciated that in other examples, the faucet body 102 may mount on a kitchen countertop and the faucet 100 may be considered a kitchen faucet. The faucet 100 also includes a flexible hose 106, a spray head 108, and one or more handles 110. In the example, the handles 110 are remote from the faucet body 102 and separately mounted on the sink basin 104, while in other aspects, a single handle may be mounted on the faucet body 102 or the sink basin 104 as required or desired.

The spray head 108 is configured to removably couple to the faucet body 102 such that the spray head 108 can be selectively positioned around the sink basin 104 by a user via the flexible hose 106. For example, the spray head 108 can be detached from the faucet body 102 so as to make it easier for the user to wash, clean and perform other actives within the sink basin 104. The spray head 108 includes an outlet nozzle 112 that discharges water from the faucet 100. The handles 110 are configured to control the flow rate and/or temperature of the water flowing through the faucet 100 and being discharged from the spray head 108. In an example, the handles 110 are hot and cold handles that are operationally coupled to corresponding hot and cold water lines (not illustrated) which are received by the faucet body 102.

In the example, the faucet body 102 includes a base 124 and a support arm 126 cantilevered from the base 124. At the free end of the support arm 126, a bracket 128 is formed and configured to releasably support the spray head 108. The base 124, support arm 126, and bracket 128 are of unitary construction such that the faucet body 102 is a single piece component and the base 124, support arm 126, and bracket 128 are not movable relative to one another. As such, when the faucet body 102 is secured to the sink basin 104, the faucet body 102 is not movable and when the spray head 108 is attached to the faucet body 102 at the bracket 128, the spray head 108 is at a fixed orientation and position above the sink basin 104. In the example, the bracket 128 is integrally formed with the support arm 126 such that the bracket 128 and the support arm 126 are fixed in position with respect to each other and not moveable relative to one another. Similarly, the support arm 126 is integrally formed with the base 124 such that the support arm 126 and the base 124 are fixed in position with respect to each other and not movable relative to one another. As such, the bracket 128 is also integrally formed with the base 124 such that the bracket 128 and the base 124 are fixed in position with respect to each other and not moveable relative to one another.

The flexible hose 106 has a first end 130 coupled to the spray head 108 and an opposite second end 132 coupled to the faucet body 102. The flexible hose 106 is configured to allow water to flow from the faucet body 102 towards the spray head 108 and dispense from the outlet nozzle 112. The flexible hose 106 has a fixed length defined between the faucet body 102 and the spray head 108 which is the same in both the attached and detached spray head configurations. This fixed length of the flexible hose 106 is also exposed and not covered by a support structure, such as a helical spring, a support sheath or cover, or the like, nor covered by the faucet body 102 or spray head 108. As such, the faucet 100 is not a pull-out hose type faucet whereby at least a portion of the hose slides within the faucet body to extend the exposed length of the hose. Rather, the flexible hose 106 of the faucet 100 is fixed in length with respect to both the spray head 108 and the faucet body 102.

In the example, the sink basin 104 may be installed in areas such as a bathroom, where a full extendable hose is not required and where hose storage space below the sink basin is not available. As such, the faucet 100 with the flexible hose 106 enables the spray head 108 to reach all portions of the sink basin 104 as required or desired and does not require storage space for the flexible hose 106.

In an aspect, the material properties of the flexible hose 106 are such that the hose is flexible enough to allow the spray head 108 to move relative to the faucet body 102 when detached (e.g., FIG. 2), but stiff enough to maintain and resiliently return to the curved shape and position above the faucet body 102 when the spray head 108 is attached to the faucet body 102 (e.g., FIG. 1), and without the use of additional components. For example, the flexible hose 106 may be formed from a rubber based material that has a thickness and/or a durometer that defines both the flexibility of movement and a stiffness for shape (e.g., a substantially curved shape). In the example, the flexible hose 106 does not have an outer covering, an outer support sheath, an external spring, or the like. Rather, the thickness of the flexible hose 106 is the only material between the water flow channel defined therein and the external environment. This configuration of the exposed flexible hose 106 and the support of the faucet body 102 provides a modern aesthetic design with increased manufacturing and assembly performance while reducing costs associated therewith.

Figure 3:
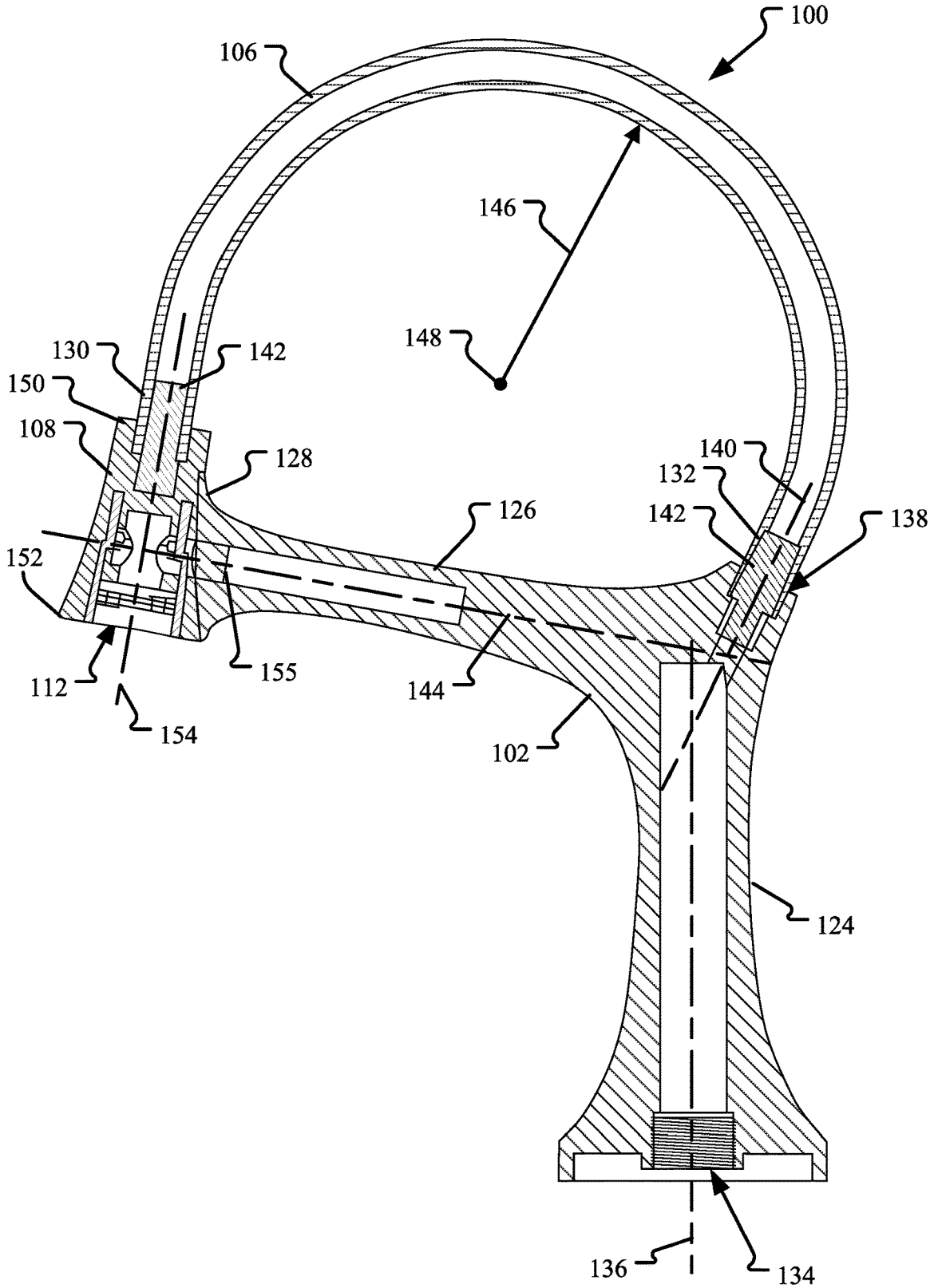
FIG. 3 is a cross-sectional view of the faucet shown in FIG. 1.

FIG. 3 is a cross-sectional view of the faucet 100. The base 124 of the faucet body 102 has a bottom inlet opening 134 that defines an inlet axis 136 and a top outlet opening 138 defining an outlet axis 140. The bottom inlet opening 134 is configured to receive one or more water lines (not shown) and/or any other valve and/or coupling component (also not shown) that enables water to enter the faucet body 102 and flow towards the spray head 108 and the outlet nozzle 112. The top outlet opening 138 is configured for the second end 132 of the flexible hose 106 to couple to the faucet body 102. In an aspect, at least a portion of the second end 132 of the flexible hose 106 is coaxial with the outlet axis 140 at the top outlet opening 138. A barbed hose fitting 142 can be used to couple the second end 132 of the flexible hose 106 to the faucet body 102 and this connection prevents rotation of the second end 132 of the flexible hose 106 around the outlet axis 140. In an aspect, the second end 132 of the flexible hose 106 is compressed between the barbed hose fitting 142 and the top outlet opening 138 to secure the flexible hose 106 to the faucet body 102.

In the example, the inlet axis 136 extends in a vertical direction so that the base 124 of the faucet body 102 is upright when mounted on a sink basin/countertop. The outlet axis 140 is non-parallel to the inlet axis 136 such that the outlet axis 140 is angled away from the support arm 126. As such, the outlet axis 140 is angled relative to the inlet axis 136. This orientation of the top outlet opening 138 at least partially enables the flexible hose 106 to form in a substantially curved shape when in the attached configuration (as illustrated in FIG. 3) and position the flexible hose 106 to align above the support arm 126 even when a portion of the second end 132 is coaxial with the outlet axis 140.

The support arm 126 extends along an arm axis 144 that intersects with both the inlet axis 136 and the outlet axis 140, but not at the same location. The arm axis 144 intersects the inlet axis 136 at a location that is above where the outlet axis 140 intersects with the inlet axis 136. The support arm 126 extends in a horizontal direction, however, in the example, the arm axis 144 is angled in an upwards direction relative to the horizontal direction. This geometry positions the bracket 128 at about the same vertical height of the top outlet opening 138 on the faucet body 102 which further helps to define the curved shape of the flexible hose 106 when the spray head 108 is attached to the bracket 128.

As illustrated in FIG. 3, the base 124 and the support arm 126 of the faucet body 102 are not rotatable around the inlet axis 136 when mounted to a sink basin or countertop, and thus, the base 124 and the support arm 126 define a plane (e.g., the cross-sectional plane shown in FIG. 3) that is parallel to and intersects with the inlet axis 136. When the spray head 108 is coupled to the faucet body 102, the flexible hose 106 is aligned with the plane defined by the base 124 and the support arm 126. Additionally, the flexible hose 106 has a substantially curved shape with respect to the cross-sectional plane. The curved shape of the flexible hose 106 can be at least partially defined by an inner radius 146 having a center point 148 that has a vertical height position that is higher than the top most position of the faucet body 102 and the top most position of the spray head 108 when attached to the bracket 128. In an aspect, the center point 148 may be positioned above an approximate midpoint of the support arm 126 between the bracket 128 and the base 124. The material properties of the flexible hose 106 at least partially define the curved shape as illustrated. Further, when the spray head 108 is disengaged with the bracket 128, the flexible hose 106 allows the spray head 108 to be positioned remote from the faucet body 102 while enabling the curved shape to be automatically resiliently returned to when the spray head 108 is attached to the bracket 128.

The spray head 108 has a top end 150 and an opposite bottom end 152. The top end 150 couples to the first end 130 of the flexible hose 106. In an example, the attachment between the spray head 108 and the first end 130 of the flexible hose 106 may be via the barbed hose fitting 142. As such, rotation of the first end 130 of the flexible hose 106 relative to the spray head 108 is prevented. The spray head 108 defines a head axis 154 that at least a portion of the first end 130 of the flexible hose 106 is coaxial with when the flexible hose 106 is attached. When the spray head 108 is attached to the faucet body 102, the head axis 154 is not parallel with the outlet axis 140 and not parallel with the inlet axis 136. Accordingly, the spray head 108 is slightly angled relative to the vertical direction when attached to the bracket 128. This orientation of the spray head 108 and the top outlet opening 138 also helps to define the curved shape of the flexible hose 106.

The bottom end 152 of the spray head 108 supports the outlet nozzle 112. The bracket 128 also releasably couples to the spray head 108 proximate the bottom end 152. By supporting the spray head 108 at the bottom end 152, the spray head 108 is not as easily accidently dislodged from the bracket 128. Additionally, attaching and detaching the spray head 108 from the bracket 128 is more efficient because most users grasp the spray head 108 proximate the top end 150.

In the example, the spray head 108 couples to the faucet body 102 with one or more magnets 155 supported in the bracket 128. The spray head 108 may be formed from a ferromagnetic material that is attracted by the magnet 155. In other aspects, the spray head 108 may include one or more magnets itself (not shown). In yet another aspect, the bracket 128 may be formed from a ferromagnetic material. By using magnetic coupling between the spray head 108 and the bracket 128, the user of the faucet 100 may easily attach and detach the spray head 108 as required or desired. It should be appreciated that any other type of releasable coupling connection may be used to attach the spray head 108 as required or desired. For example, but not limited to, a push button release, a snap fit coupling, a slide fit, a resilient friction coupling, and the like.

Figure 5:
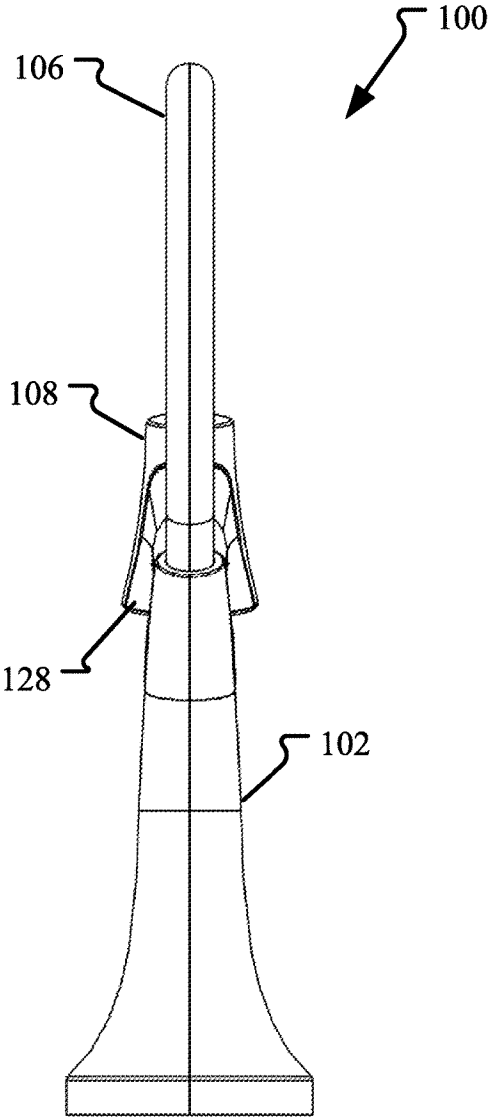
FIG. 5 is a rear view of the faucet shown in FIG. 1.
Figure 4:
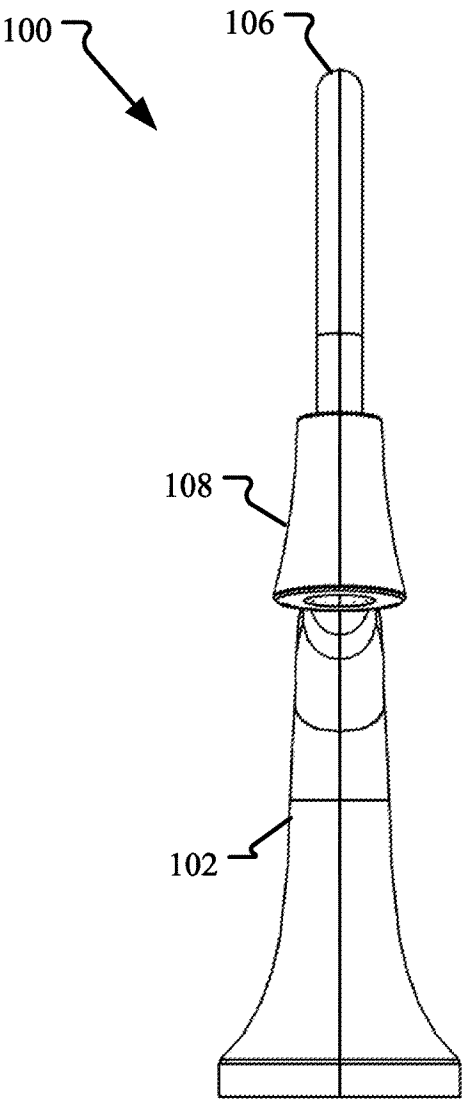
FIG. 4 is a front view of the faucet shown in FIG. 1.
Figure 7:
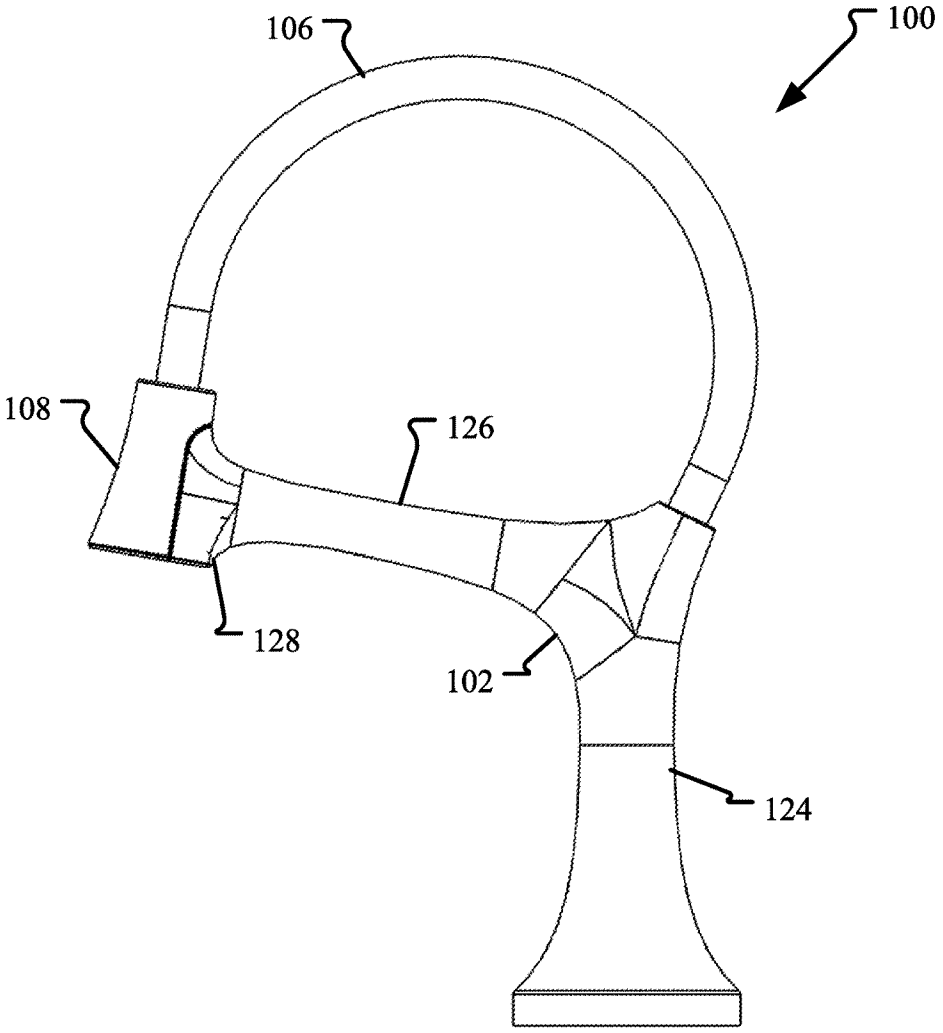
FIG. 7 is a side elevation view of the faucet shown in FIG. 1.
Figure 6:
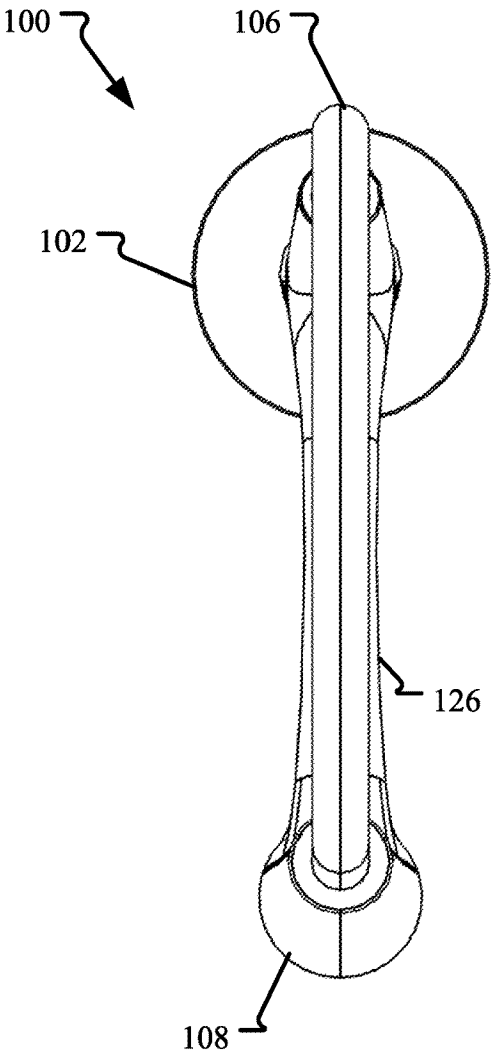
FIG. 6 is a top view of the faucet shown in FIG. 1.

FIG. 4 is a front view of the faucet 100. FIG. 5 is a rear view of the faucet 100. FIG. 6 is a top view of the faucet 100. FIG. 7 is a side elevation view of the faucet 100. Referring concurrently to FIGS. 4-7, the faucet 100 includes the flexible hose 106 that enables the spray head 108 to be detached from the faucet body 102 and so as to wash, clean, and perform other faucet activities. The faucet body 102 is fixed in position so as to hold and support the spray head 108 in a fixed and non-movable position until the user requires or desires detachment of the spray head 108 to use the flexible hose 106 to then enable the spray head 108 to be movable in position.

In the example, the spray head 108 does not include any buttons and/or flow/spray controls such that the handles 110 (shown in FIGS. 1 and 2) control the flow and temperature of the water from the faucet 100. Rather, the exterior surfaces of the faucet body 102 and the spray head 108 have a modern aesthetic with smooth curves. As shown in the front view of FIG. 4, the bracket 128 may not be visible from the front as it is behind the spray head 108. The flexible hose 106 is exposed and extends between the faucet body 102 and the spray head 108. The flexible hose 106 has a curved shape and disposed above and aligned with the support arm 126 of the faucet body 102. The exposed flexible hose 106 communicates to the user that the spray head 108 can be detached as required or desired without the use of buttons or the like.

Figure 8:
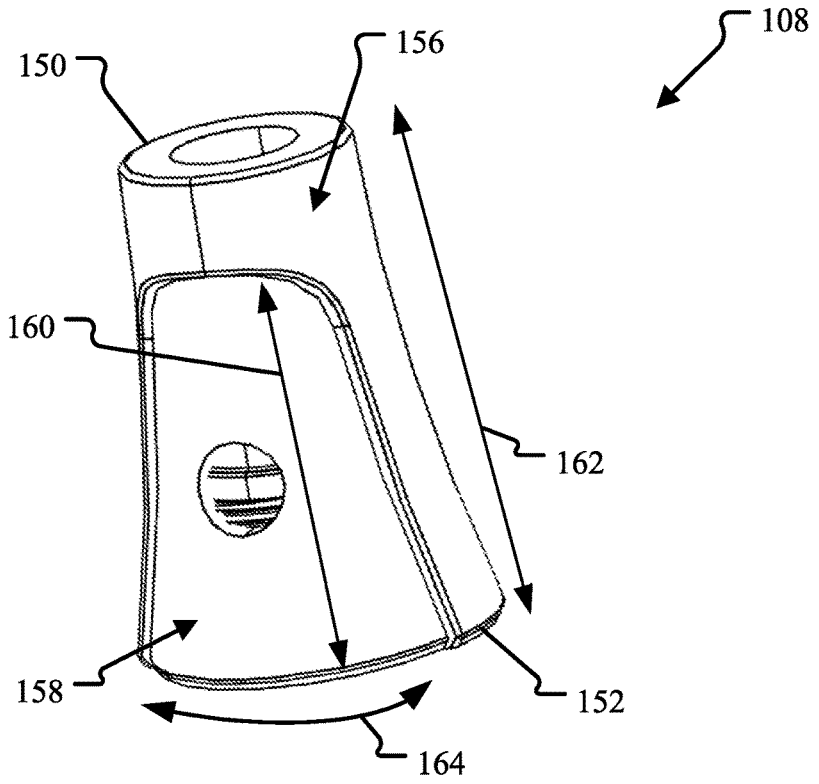
FIG. 8 is a perspective view of an exemplary spray head of the faucet shown in FIG. 1.
Figure 9:
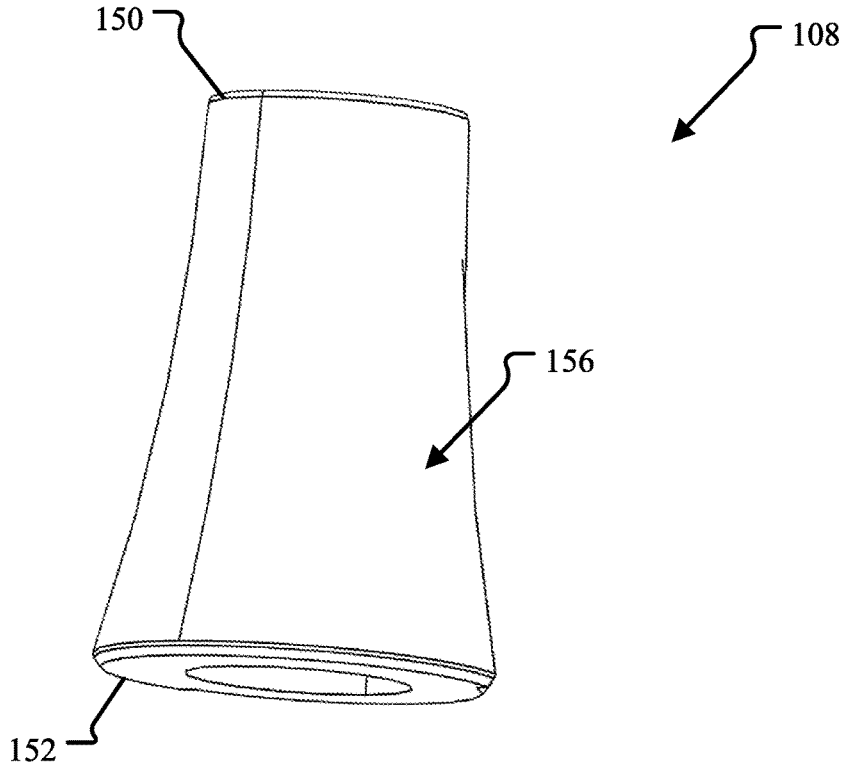
FIG. 9 is another perspective view of the spray head shown in FIG. 8.

FIG. 8 is a perspective view of the spray head 108. FIG. 9 is another perspective view of the spray head 108. Referring concurrently to FIGS. 8 and 9, the spray head 108 has a substantially frustoconical shape with the top end 150 that coupled to the flexible hose and the bottom end 152 configured to discharge water from the faucet. The spray head 108 has an outer surface 156 that extends all the way around the spray head 108 between the top end 150 and the bottom end 152. A recess 158 is formed within the outer surface 156 that is configured to receive the bracket 128 of the faucet body 102 (both shown in FIGS. 1 and 2).

In the example, the recess 158 extends from the bottom end 152 (e.g., starts at the bottom end 152) towards the top end 150. In an aspect, a height 160 of the recess 158 is greater than half of a height 162 of the spray head 108 defined between the top end 150 and the bottom end 152. In an aspect, the height 160 of the recess 158 is between 50% and 90% of the height 162 of the spray head 108. In another aspect, the height 160 of the recess 158 is between 60% and 80% of the height 162 of the spray head 108. In yet another aspect, the height 160 of the recess 158 is about 75% of the height 162 of the spray head 108.

The recess 158 also has a circumferential length 164. In an aspect, the circumferential length 164 extends at least 100° around the body of the spray head 108. In another aspect, the circumferential length 164 extends at least 120° around the body of the spray head 108. The height 160 and the length 164 of the recess 158 at least partially define a surface area of the recess 158 relative to a total surface area of the outer surface 156 of the spray head 108. In an aspect, the surface area of the recess 158 is more than 25% of the total surface area of the outer surface 156 of the spray head 108. In another aspect, the surface area of the recess 158 is between 25% and 50% of the total surface area of the outer surface 156 of the spray head 108. In still another aspect, the surface area of the recess 158 is between 25% and 40% of the total surface area of the outer surface 156 of the spray head 108.

With the recess 158 being positioned proximate the bottom end 152 of the spray head 108 and having an increased surface area, the support strength from the bracket 128 is increased so that it is more difficult to unintentionally detach the spray head 108 from the bracket 128. For example, with spray head attachments that are coupled at the top end, it is easier for the user to knock and accidently detach the spray head when using the faucet. Additionally, the increased surface area increases ease of attachment of the spray head 108 to the bracket 128 so that the user can more easily operate the faucet 100.

In the example, the recess 158 has a depth that allows the recess 158 to completely receive the bracket 128 so that the bracket 128 is substantially flush with the outer surface 156 of the spray head 108 when it is coupled thereto.

Figure 10:
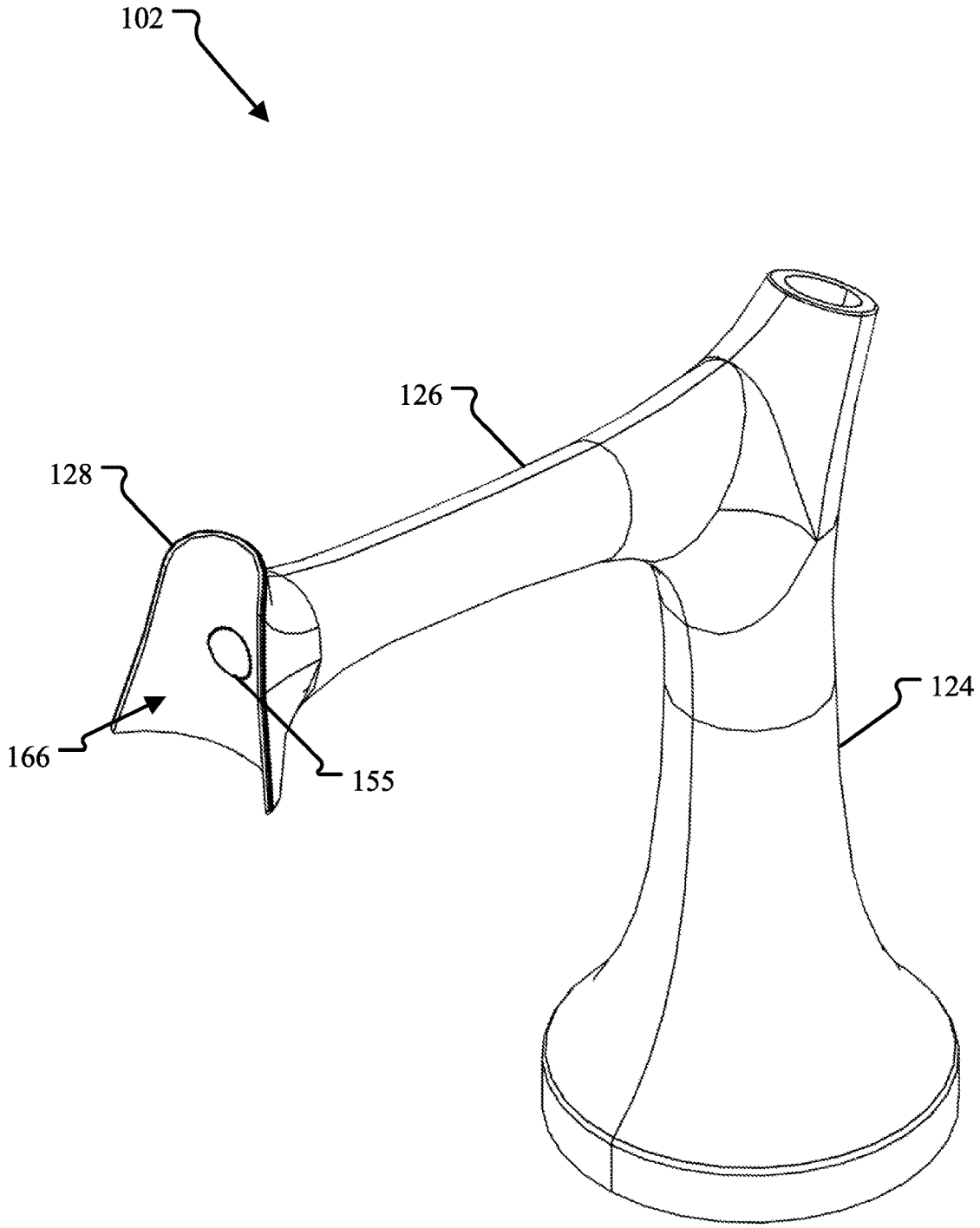
FIG. 10 is a perspective view of an exemplary faucet body of the faucet shown in FIG. 1.

FIG. 10 is a perspective view of an exemplary faucet body 102. The faucet body 102 includes the base 124, the support arm 126, and the bracket 128. In this example, the base 124, the support arm 126, and the bracket 128 are all fixed relative to one another. The bracket 128 has a receiving surface 166 that is configured to support the magnet 155. Additionally, the bracket 128 has a C-shape that corresponds to the size and shape of the recess 158 of the spray head 108 (shown in FIG. 8). In an aspect, the bracket 128 extends at least 100° around the body of the spray head 108. In another aspect, the bracket 128 extends at least 120° around the body of the spray head 108. The thickness of the bracket 128 corresponds to the depth of the recess 158 so that the recess 158 can completely receive the bracket 128.

The top of the bracket 128 is smaller than the bottom of the bracket 128. This configurations provides more support and coupling surface to the bottom end 152 of the spray head 108 (shown in FIG. 8) so as to increase the coupling strength of the bracket 128 while still enabling the spray head 108 to detach as required or desired.

Figure 11:
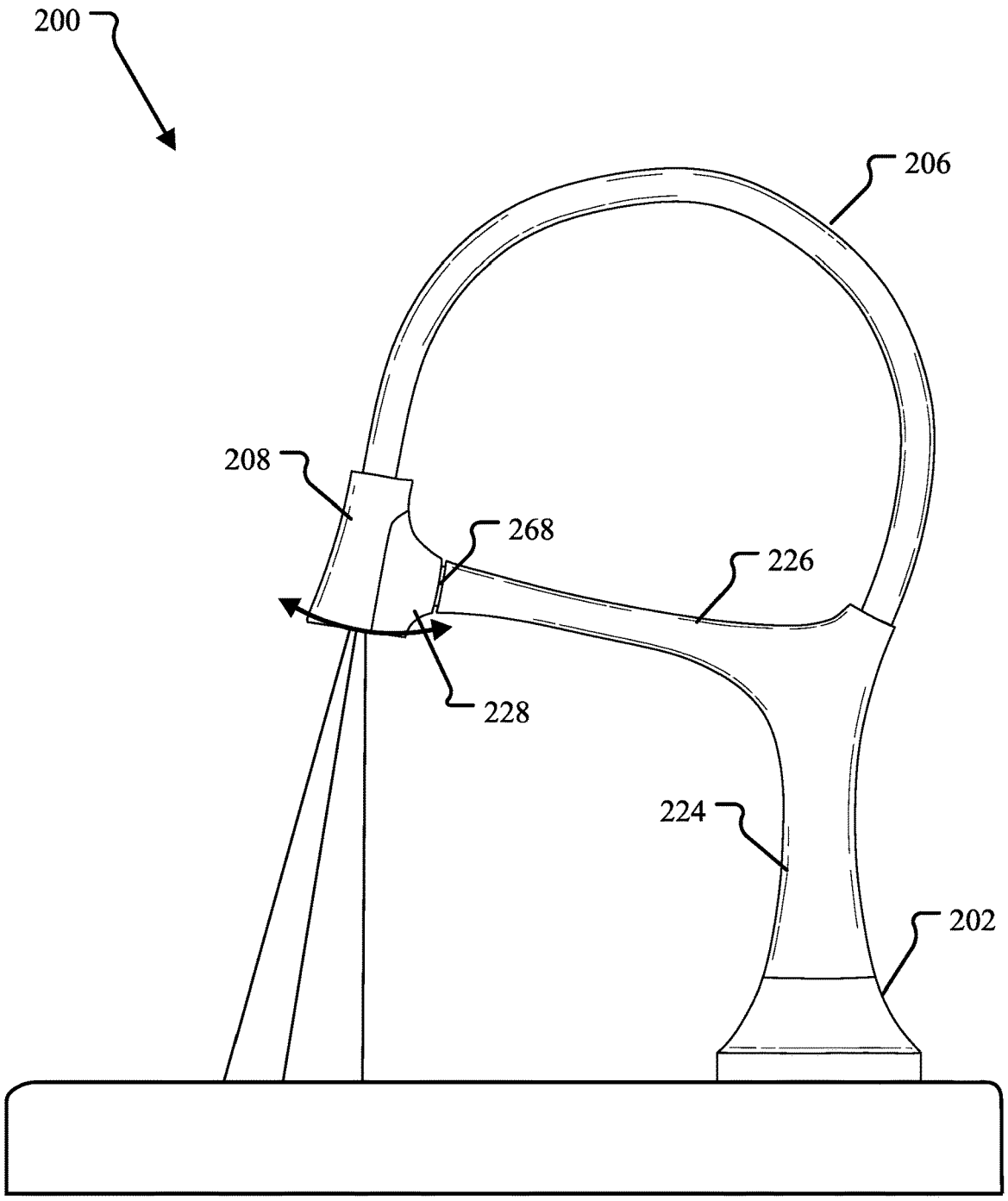
FIG. 11 is a side elevation view of another faucet.

FIG. 11 is a side elevation view of another faucet 200. Similar to the faucet 100 described above, the faucet 200 includes a faucet body 202, a flexible hose 206, and a detachable spray head 208. The faucet body 202 includes a base 224, a support arm 226, and a bracket 228. As illustrated in FIG. 11 the spray head 208 is in an attached configuration whereby the spray head 208 is releasably coupled to the bracket 228. In this example, the support arm 226 is fixed relative to the base 224 of the faucet body 202 as described above, however, the bracket 228 is coupled to the free end of the support arm 226 with a pivot joint 268 so that the orientation of the spray head 208 is adjustable when attached to the bracket 228. The pivot joint 268 being located at the free end of the support arm 226 also allows the spray head 208 to be moved while attached to the bracket 228. In an aspect, the pivot joint 268 may be a ball joint or any other connection type that enables the bracket 228 to function as described herein.

The connection configuration between the spray head 208 and the bracket 228 described above (e.g., the recess within the bottom end of the spray head and the C-shaped bracket) provide additional performance benefits while in use with the pivot joint 268. For example, by coupling the bottom end of the spray head 208 to the bracket 228, the user may more easily move the spray head 208 to different orientations while being coupled to the bracket 228 without undesirable detachment.

Figure 12:
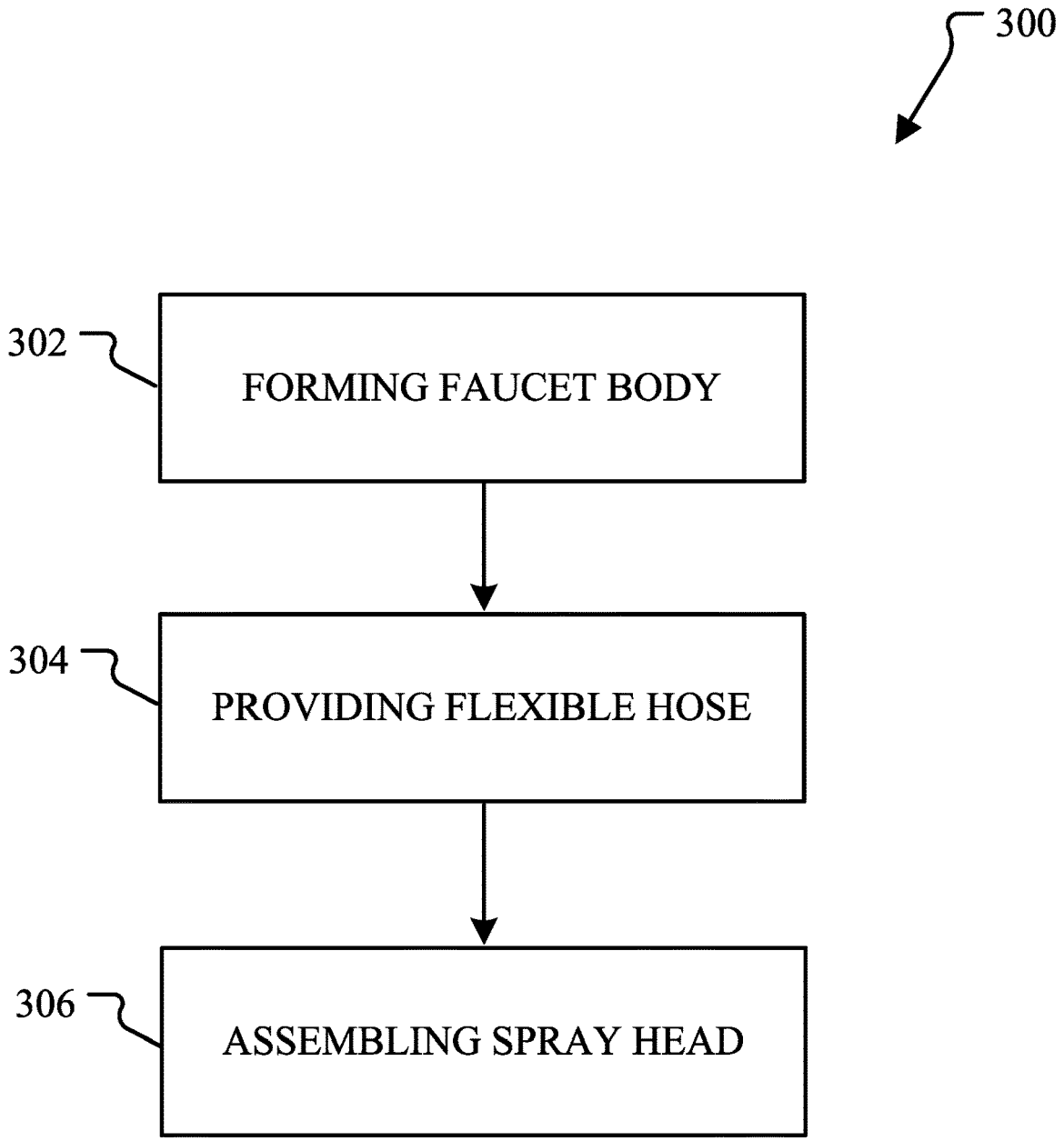
FIG. 12 is a flowchart illustrating an exemplary method of manufacturing a faucet.

FIG. 12 is a flowchart illustrating an exemplary method 300 of manufacturing a faucet. The faucet being manufactured by the method 300 may be the same or similar to the faucets 100, 200 described above and shown in FIGS. 1-11. The faucet includes a faucet body that can releasable support a spray head that is coupled in fluid communication with the faucet body with an exposed and fixed length flexible hose. As such, the spray head can be undocked so that the user can wash, clean, and perform other faucet functions. The flexible hose is configured to return to a curved shape above the faucet body when the spray head is docked so that the functionality of the faucet is conveyed to the user while still providing a modern stylish overall appearance.

The method 300 begins with forming a faucet body at operation 302. The faucet body includes a base, a support arm, and a bracket. In some aspects, the base, the support arm, and the bracket are all fixed features relative to one another and the faucet body is of unitary construction. In an example, the faucet body may be a molded component. In another aspect, the base and the support arm are fixed features relative to one another and of unitary construction. The bracket may be pivotably coupled to the free end of the support arm as required or desired.

The method 300 further includes providing a flexible hose at operation 304. The flexible hose is coupled to the faucet body at one end and couples to the spray head at the opposite end. The flexible hose is formed from a material that is flexible enough to facilitate the spray head being movable relative to the faucet body by the user when the spray head is detached from the faucet body, but stiff enough to have the flexible hose support itself and resiliently maintain a curved shape above the faucet body when the spray head is attached to the faucet body. In an aspect, a thickness and/or a durometer at least partially define the flex and stiffness properties of the flexible hose. Additionally, the method 300 includes assembling a spray head at operation 306. The spray head is configured to discharge water from the faucet. The spray head may include any outlet nozzle pattern as required or desired. In the example, the spray head may releasably attach to the bracket via a magnetic coupling connection. As such, the spray head may include one or more magnets or ferromagnetic material.

Referring to FIGS. 1-12 generally, it is noted that the faucet described herein is particularly adaptable to installations at smaller sinks, such as in a bathroom, where a full pull-out faucet having an extendable hose is not required and where significant hose storage space for a pull-out hose below the sink or countertop is not available. In such cases, some flexibility may nevertheless be desirable to reach all portions of such a sink. Still further, in such installation circumstances, it may be preferable to have a fixture having a non-pivotable body (e.g., as in typical bathroom installations) rather than a pivotable body and support arm to provide an consistent aesthetic look. The faucet embodiments described herein therefore provide the aesthetic consistency benefits and compactness of a bathroom faucet, while providing spray head maneuverability to facilitate sink basin cleaning, filling tall containers, and the like.

References in the specification to "one example," "an example," "an illustrative example," etc., indicate that the example described may include a particular feature, structure, or characteristic, but every example may or may not necessarily include that particular feature, structure, or characteristic. Moreover, such phrases are not necessarily referring to the same example. Further, when a particular feature, structure, or characteristic is described in connection with an example, it is submitted that it is within the knowledge of one skilled in the art to affect such feature, structure, or characteristic in connection with other examples whether or not explicitly described. Additionally, it should be appreciated that items included in a list in the form of "at least one A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C). Moreover, one having skill in the art will understand the degree to which terms such as "about," "approximately," or "substantially" convey in light of the measurements techniques utilized herein. To the extent such terms may not be clearly defined or understood by one having skill in the art, the term "about" shall mean plus or minus ten percent.

From the forgoing detailed description, it will be evident that modifications and variations can be made in the aspects of the disclosure without departing from the spirit or scope of the aspects. While the best modes for carrying out the many aspects of the present teachings have been described in detail, those familiar with the art to which these teachings relate will recognize various alternative aspects for practicing the present teachings that are within the scope of the appended claims.

What is claimed:

1. A faucet comprising:

a faucet body including:

a base having a bottom inlet opening and a top outlet opening;

a support arm cantilevered from the base and having a free end; and a bracket formed on the free end of the support arm, wherein the base, the support arm, and the bracket are of unitary construction;

a flexible hose having a first end and an opposite second end, the second end coupled to the top outlet opening of the base; and a spray head having a top end and an opposite bottom end, the top end coupled to the first end of the flexible hose such that the flexible hose has a fixed length between the faucet body and the spray head, the spray head having an outer surface with a recess formed therein and configured to receive the bracket such that the spray head is releasably coupled to the faucet body, wherein the recess extends from the bottom end towards the top end such that a height of the recess extends over half of a height of the spray head.

2. The faucet of claim 1, wherein the spray head is substantially frustoconical in shape with the outer surface being curved between the top end and the bottom end, and wherein the recess has a circumferential length, and wherein a surface area of the recess within the outer surface is more than 25% of a total surface area of the outer surface of the spray head.

3. The faucet of claim 1, wherein when the spray head is coupled to the faucet body, the flexible hose has a curved shape that aligns above the support arm.

4. The faucet of claim 3, wherein when the spray head is disengaged with the bracket, the flexible hose allows the spray head to be moved by a user to a position remote from the faucet body while resiliently returning to the curved shape when the spray head is coupled to the faucet body.

5. The faucet of claim 3, wherein the curved shape is based on a thickness and a durometer of the flexible hose.

6. The faucet of claim 1, wherein the bottom inlet opening defines a vertical axis, the top outlet opening having an outlet axis that is angled relative to the vertical axis.

7. The faucet of claim 1, wherein when the spray head is coupled to the faucet body, the first end of the flexible hose defines a first axis and the second end of the flexible hose defines a second axis, wherein the first axis is not parallel with the second axis, and wherein the first axis and the second axis are each not parallel with a vertical axis.

8. A faucet comprising:

a faucet body including:

a base having a bottom inlet opening defining an inlet axis and a top outlet opening defining an outlet axis, the inlet axis being non-parallel to the outlet axis;

a support arm cantilevered from the base and having a free end; and a bracket disposed at the free end of the support arm;

a flexible hose having a first end and an opposite second end, the second end coupled to the top outlet opening of the base and at least a portion of the second end of the flexible hose is coaxial with the outlet axis; and a spray head coupled to the first end of the flexible hose such that the flexible hose has a fixed length between the faucet body and the spray head, the spray head being releasably coupled to the faucet body at the bracket.

9. The faucet of claim 8, wherein the base and the support arm are not rotatable around the inlet axis, and the base and the support arm define a plane parallel with the inlet axis.

10. The faucet of claim 9, wherein when the spray head is coupled to the faucet body, the flexible hose has a substantially curved shape and is aligned with the plane defined by the base and the support arm.

11. The faucet of claim 8, wherein the flexible hose does not include a spring or an outer support sheath.

12. The faucet of claim 8, wherein the outlet axis of the top outlet opening is angled away from a direction that the support arm extends from the base.

13. The faucet of claim 8, wherein the bracket is coupled to the free end of the support arm via a pivot joint such that the bracket is pivotable relative to the support arm.

14. The faucet of claim 8, wherein the spray head has a top end coupled to the first end of the flexible hose and an opposite bottom end, the bottom end of the spray head configured to attach to the bracket.

15. A faucet comprising:

a faucet body including:

a base having a bottom inlet opening defining an inlet axis and a top outlet opening defining an outlet axis, the outlet axis angled relative to the inlet axis;

a support arm cantilevered from the base and having a free end; and a bracket formed on the free end of the support arm, wherein the base, the support arm, and the bracket are of unitary construction such that the bracket has a fixed position on the faucet body;

a flexible hose having a first end and an opposite second end, the second end coupled to the top outlet opening of the base;

a spray head having a top end and an opposite bottom end, the top end coupled to the first end of the flexible hose such that the flexible hose has a fixed length between the faucet body and the spray head that is exposed, the spray head having an outer surface with a recess formed therein and configured to completely receive the bracket such that the outer surface is substantially flush with the bracket, wherein the bracket releasably couples the spray head to the faucet body, and wherein the recess is disposed proximate the bottom end of the spray head;

wherein rotation of the second end of the flexible hose around the outlet axis is prevented.

16. The faucet of claim 15, wherein rotation of the first end of the flexible hose relative to the spray head is prevented.

17. The faucet of claim 15, wherein the flexible hose is defined by a thickness and a durometer such that the spray head is movable relative to the faucet body when detached from the bracket, and maintains a substantially curved shape when the spray head is coupled to the bracket above the spray head and the faucet body.

18. The faucet of claim 15, further comprising at least one faucet handle disposed remote from the faucet body.

19. The faucet of claim 15, wherein the bracket is C-shaped, and wherein when the spray head is coupled to the bracket, the bracket extends at least 120° around the spray head.

* * * * *